United States Patent [19]

Peters

[11] 4,044,934

[45] Aug. 30, 1977

[54] TENNIS RACQUET AND BALL CARRIER FOR BICYCLES

[76] Inventor: Frederick E. Peters, 14720 Richmond, Southgate, Mich. 48195

[21] Appl. No.: 571,593

[22] Filed: Apr. 25, 1975

[51] Int. Cl.[2] ..... B62J 11/00

[52] U.S. Cl. ..... 224/36; 248/226.5; 273/74

[58] Field of Search ..... 224/5 D, 30 R, 30 A, 224/31, 32 R, 33 R, 33 A, 35, 36, 37, 39, 41, 42.45 R, 45 L, 46 R, 32 A, 42.46 R; 280/202, 289 R, 289 A; 273/73 R, 74; 248/226 E, 230, 231, 229; D12/158; 24/3 R, 3 J, 3 L, 73 AS, 81 BA

[56] References Cited

U.S. PATENT DOCUMENTS

| | | | |
|---|---|---|---|
| 593,978 | 11/1897 | Boehm | 224/37 |
| 1,222,458 | 4/1917 | Peterson | 224/36 X |
| 1,807,501 | 5/1931 | Alexander | 224/39 R X |
| 2,088,980 | 8/1937 | Stein | 224/5 D X |
| 2,444,585 | 7/1948 | Tubiolo | 224/42.45 R X |
| 2,926,912 | 3/1960 | Gould | 224/5 D X |
| 3,186,414 | 6/1965 | Davis | 224/42.46 R X |
| 3,907,239 | 9/1975 | Ehrlich | 248/231 X |
| 3,968,912 | 7/1976 | Horwitz | 224/42.46 R X |

FOREIGN PATENT DOCUMENTS

| | | | |
|---|---|---|---|
| 785,300 | 10/1957 | United Kingdom | 248/229 |
| 20,704 | 11/1900 | United Kingdom | 224/37 |
| 12,394 | 5/1910 | United Kingdom | 224/30 A |

*Primary Examiner*—Robert J. Spar
*Assistant Examiner*—Winston H. Douglas
*Attorney, Agent, or Firm*—Andrew R. Basile

[57] ABSTRACT

An improved tennis racquet press for attaching a bracket member designed to carry a can of tennis balls, and means for attaching clips designed to engage with the frame of a bicycle wheel in order that a tennis racquet and a can of tennis balls may be efficiently and easily transported on a bicycle frame.

1 Claim, 6 Drawing Figures

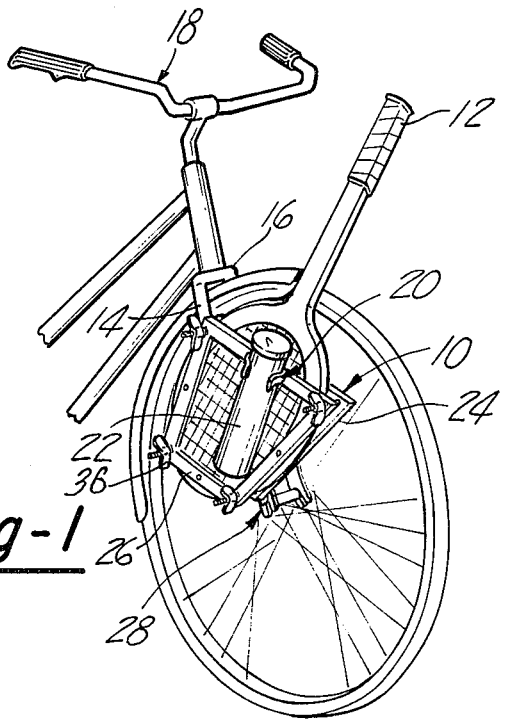
Fig-1
Fig-2
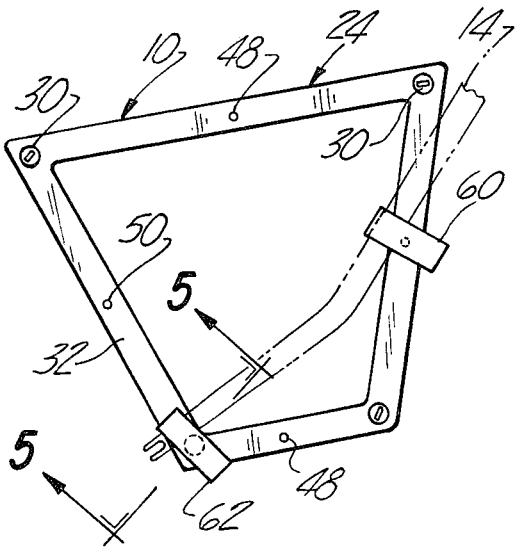
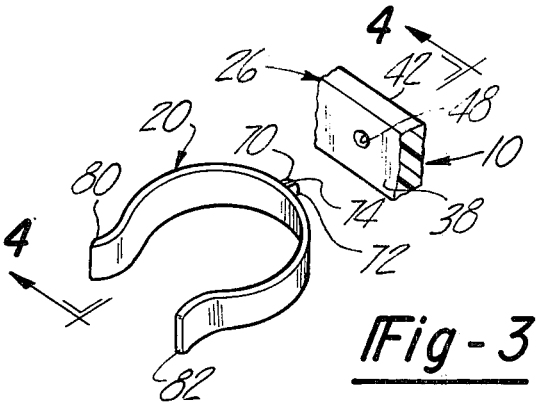
Fig-3
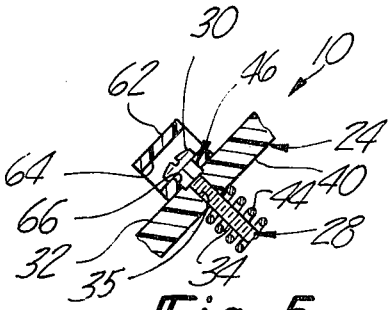
Fig-5
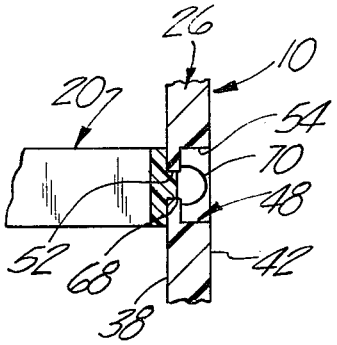
Fig-4
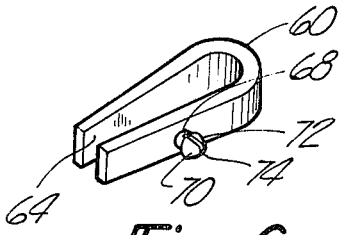
Fig-6

TENNIS RACQUET AND BALL CARRIER FOR BICYCLES

BACKGROUND OF THE INVENTION

I. Field of the Invention

The present invention relates to a tennis racquet press and, in particular, to a tennis racquet press designed to carrying not only a tennis racquet, but also a can of tennis balls. Further, it relates to a tennis racquet press designed to be attached to the frame of a bicycle wheel in such a manner as to not interfere with the pedal or wheel motion of the moving bicycle.

II. Description of the Prior Art

Tennis racquet presses have been in common use for years. The main purpose of a racquet press is to protect the racquet itself when it is not being used for playing tennis. In ordinary use, a tennis player traveling by bicycle to the tennis courts must carry both the tennis racquet and a can of tennis balls and control the bicycle handlebars while he proceeds to attempt to steer the bicycle to reach his destination. It is an awkward situation trying to juggle a tennis racquet, weighed down by a racquet press, and a can of tennis balls all while trying to peddle and steer the bicycle.

This is a very clumsy and, particularly, in a case where the person is a youngster, a potentially dangerous method of carrying tennis equipment. The problem of transporting bulky, cumbersome items while riding a bicycle has been a long standing one. Several rather successful innovations have appeared as solutions. J. R. Reed, Jr., U.S. Pat. No. 3,142,424, discloses a gun holder for bicycles which consists of an elongated boot-type holder, easily attached to the fender of a bicycle. Thatcher Kezer, U.S. Pat. No. 3,744,688 shows a carrier device for transporting rod-shaped items such as fishing poles on a wheeled vehicle. Attachment of the carrier to the vehicle is accomplished on the front wheel frame. Another type of scabbard mount, or boot mount device is shown in Utigard's U.S. Pat. No. 3,806,010. The point of attachment here is on the handlebars. Other disclosures of means for carrying items on a vehicle, such as bicycle, are disclosed in U.S. Pat. No. 611,905 and U.S. Pat. No. 2,850,221. Although all of these devices are useful and achieve their desired results of transporting an item on a wheeled vehicle, if a tennis racquet were carried by any one of them, the result would still be a rather clumsy and not particularly safe way of transporting the racquet. In fact, none of these prior art designs were contemplated with a tennis racquet in mind, and assuredly not with both a racquet and a can of tennis balls in mind. The present invention overcomes any disadvantages that might result from either carrying a racquet and a can of tennis balls in the hands, or in one of the ill-suited previously mentioned prior art devices, and instead offers a compact, inventive adaption of a tennis racquet press as a method of transporting tennis gear to its destination on a wheeled vehicle.

SUMMARY OF THE INVENTION

The subject patent application offers a novel, extremely simple, and thoroughly complete means of transporting a tennis racquet and a can of tennis balls via a wheeled vehicle with optimum efficiency and speed.

It is an object of this invention to utilize the tennis racquet press to attach the racquet to the wheeled vehicle, thereby providing a means of carrying the racquet in a manner other than manually.

It is a further object of this invention to utilize the tennis racquet press to carry a can of tennis balls.

It is a still a further object of this invention to provide a safe, but necessarily simple and readily accomplished, method of transporting tennis equipment on a wheeled vehicle.

Other objects, advantages, and applications of the present invention will become apparent to those skilled in the art of tennis racquet presses when the accompanying description of one example of the best mode contemplated for practicing the invention is read in conjunction with the accompanying drawing.

BRIEF DESCRIPTION OF THE DRAWING

The description herein makes reference to the accompanying drawing wherein like reference numerals refer to like parts throughout the several views, and in which:

FIG. 1 is a perspective frontal view of one example of the present invention in the form of tennis racquet press mounted to the steering column of conventional bicycle;

FIG. 2 is a rear elevational view of the tennis racquet press with the fork of the bicycle steering column, illustrated in phantom lines;

FIG. 3 is a fragmentary exploded perspective view of a portion of the tennis racquet press, illustrated in FIG. 1;

FIG. 4 is a fragmentary cross-sectional view of the tennis racquet press taken along line 4—4 of FIG. 3;

FIG. 5 is a fragmentary cross-sectional view of the tennis racquet press taken along Line 5—5 of FIG. 2; and FIG. 6 is a perspective view of an element of the tennis racquet press, illustrated in the several views.

DESCRIPTION OF THE PREFERRED EMBODIMENT

Referring now to the drawing and, in particular, to FIG. 1 wherein there is illustrated one example of the present invention in the form of a tennis racquet press 10 which is used in the conventional manner for holding a tennis racquet 12 and which is mounted in a manner to be described hereinafter in greater detail to the leg 14 of the steering column fork 16 of a conventionaltype bicycle 18. The press 10, in addition to providing support for the tennis racquet 12, is provided with a holder 20 which functions to carry a tennis ball container 22, all of which will be described in greater detail hereinafter.

The tennis racquet press 10 is comprised of two trapezoidally-shaped press members 24 and 26 which are interconnected at their corners by a plurality of threaded fasteners or screws 28 which have their head portion 30 (FIGS. 2 and 5) adjacent to the outside surface 32 of the press member 24 while the posts 34 of each threaded fastener 28 extends through suitable apertures 35 in the press members 24 and 26 for threaded engagement with wing nuts 36 (FIG. 1) disposed on the outside surface 38 of the press member 26. The opposing inner surfaces 40 and 42, respectively, of the press members 24 and 26 are maintained apart by means of coil-type springs 44 that circumscribe the posts 34 of each of the screws 28. The head portion 30 of each screw 28 is provided with a square-shaped configuration 46 which is received within a complementary shaped squareshaped aperture (unnumbered) formed in the outside surface 32 of the press member 24 such that the wing nuts 36 may be turned while the posts 34 are maintained in a stationary position with respect to the press members whereby the inner surfaces 40 and 42, respectively, of the press members 24 and 26 may be brought under pressure against the tennis racquet 12 to maintain the same in a proper position. The compression of the tennis racquet 12 is conventional and well-known to those skilled in the art of tennis racquet presses.

As can best be seen in FIGS. 2, 3, and 4, each of the press members 24 and 26 is provided with step bores 48 on the large and small bases of the trapezoidally-shaped press members and step bores 50 on each of the legs of the press members. Each of the step bores 48 and 50, as can best be seen in FIG. 4, has a narrowed diametered section 52 which opens on one side to the outside surface 38 of the press member 26 (the inner surface 40 of the press member 24) and a larger diametered bore 54 which, in turn, opens to the inside surface 42 of the press member 26 (the inside surface 32 of the press member 24). The step bores 48 and 50 are so sized as to receive in a snap-lock fashion the elements which are utilized to attach the tennis ball container 20 to the press members and for attaching the press 10 to the bicycle 18, all of which will be described in greater detail hereinafter.

As can best be seen in FIGS. 2, 5, and 6, the press 10 is attached to the bicycle 18 by means of clips 60 and 62 each of which are fabricated from a resilient plastic such as a nylon. Each clip 60 and 62 has a U-shaped configuration such that the legs of each member defines a slot 64 which receives the leg 14 of the bicycle 18 in a snap-lock engagement to securely mount the press 10 to the bicycle steering column fork 16. As can best be seen in FIG. 5, the clip 62 is provided with a central aperture 66 having a square shape that is complementary to the square head 46 of the screw 28 such that the screw 28 engages the clip 62 and will not rotate when the wing nut 36 is rotated so as to bring the presses into a close contact with the tennis racquet 12, as described hereinbefore. Thus, the one clip 62 is secured at one corner of the press member 24, that is, on the outside surface 32 of the press member 24.

The second clip 60 (FIG. 6) is selectively positionable in any of the apertures 50 or 48 on the outside surface 32 of the press member 24 and, in most applications, the clip 60 is inserted in the aperture 50, as shown in FIG. 2, in a snap-lock engagement to secure the clip 60 to the press member 24. This attachment is accomplished by means of a post 68 integrally formed with one leg of the clip 60. The post 68 terminates in a pair of fingers 70 and 72 which are separated by a slit 74 and is fabricated of a flexible material such that the fingers will move toward and away from each other as the fingers 70 and 72 are inserted through the aperture 52; and once the fingers 70 and 72 have passed through the aperture 52 into the enlarged diametered portion 54 of the step bore 50, the fingers will be separated and the backsides thereof will engage the step bore 50 as shown in FIG. 4 of the drawing to lockingly secure the clip 60 to the press member 24. It should be understood that the engagement is such that upon the application of sufficient pressure to the clip 60, the same may be withdrawn manually from the step bore 50.

Referring now to FIGS. 1, 3, and 4 for a description of the container-holder 20 which is utilized to attach the tennis ball container 22 to the outside surface 38 of the press member 26. The container-holder 20 is fabricated from a flexible material such as a nylon or other suitable plastic and has a horseshoe shape generally complementary to the outer diameter of the conventional tennis ball containers such that the container 22 may be inserted between the spaced opened ends 80 and 82 of the holder 20 and snap into the circular portion 48 of the holder 20 and secured thereto. At the same time the backside of the holder 20 is provided with a post 68 having the spaced apart fingers 70 and 72 defining the slit 74 such that the posts and fingers may be inserted into the aperture 48 on the larger base of the press member 26 and secured thereto in a snap-lock fashion, as shown in FIGS. 1, 3, and 4. It should also be understood that the snap-lock engagement of the container mounting holder 20 is such that the same may be removed from the engagement with the press member 26 if desired.

It can be seen that in use the container of tennis balls 22 is attached to the container mounting holder 20 for facilitating the easy carrying of the tennis balls with the tennis racquet 12 and press 10. At the same time by simply snapping the clips 60 and 62 into a snap-lock engagement with the leg 14 of the fork 16 of the bicycle 18, the press 10, tennis balls 22, and tennis racquet 12 are easily transported by the user who is driving the bicycle 18 without concern for holding onto the tennis racquet and its press or the container with the tennis balls therein.

It can thus be seen that the present invention has provided a new and improved tennis racquet press which facilitates the carrying of the tennis racquet along with tennis balls used by the player and which can be easily and quickly mounted to and detached from a bicycle or other suitable transporting vehicles.

While only one example of the present invention has been disclosed, it should be apparent to those skilled in the art of tennis racquet presses and the like that other forms may be had, all coming within the spirit of the invention and scope of the appended claims.

What is claimed is as follows:

1. A tennis racquet press adapted to be mounted to the fork of the steering column of a conventional bicycle, said tennis racquet press comprising:

a pair of spaced press members and first connecting means for compressing said press members toward one another to press against a tennis racquet disposed thereinbetween;

second connecting means carried on the outside surface of one of said press members for releasable attachment of said press to said cycle wheel frame, said second connecting means comprising first and second U-shaped clips each having a base and legs, each clip legs fabricated from a flexible material permitting the clip legs to receive a portion of said cycle wheel frame in a snap-locking relationship, one of said first U-shaped clip legs having a flexible post projecting outwardly therefrom, the outside surface of said one press member having a plurality of apertures, one of which selectively and releasably receives said flexible post for attaching said first clip to said one press member such that said first clip is pivotally mounted to said one press member;

one of said second U-shaped clip legs having an aperture through which said first connecting means extends for attaching said second clip to said one press member; and third connecting means carried on the outside surface of the other of said press members for releasably attaching a tennis ball container, said third connecting means comprising a horseshoe-shaped member, the extended ends thereof being adapted to receive and snap lockingly engage said tennis ball container, said horseshoe-shaped member having flexible post projecting outwardly therefrom the outside surface of, said other press member having a plurality of apertures, one of which selectively and releasably receives said flexible post for attaching said horseshoe-shape member to said other press member such that said horseshoe-shaped member is disposed in a plane which is perpendicular to said other press member and pivotal about an axis which is perpendicular to said other press member.

* * * * *